US007429158B2

(12) United States Patent
McFarland

(10) Patent No.: US 7,429,158 B2
(45) Date of Patent: Sep. 30, 2008

(54) EXPANDABLE IMPLEMENT ATTACHMENT

(76) Inventor: David L. McFarland, 8148 - 134th Ave. SE., Gwinner, ND (US) 58040

( * ) Notice: Subject to any disclaimer, the term of this patent is extended or adjusted under 35 U.S.C. 154(b) by 0 days.

(21) Appl. No.: 11/220,226

(22) Filed: Sep. 6, 2005

(65) Prior Publication Data

US 2006/0182590 A1 Aug. 17, 2006

Related U.S. Application Data

(60) Provisional application No. 60/607,563, filed on Sep. 7, 2004.

(51) Int. Cl.
*E02F 3/00* (2006.01)

(52) U.S. Cl. ..... 414/722; 37/274; 37/411

(58) Field of Classification Search ..... 414/722, 414/725, 726; 37/411, 409, 274; 172/811, 172/815

See application file for complete search history.

(56) References Cited

U.S. PATENT DOCUMENTS 3,782,573 A * 1/1974 Garwood ..... 414/705
4,633,601 A * 1/1987 Fleck et al. ..... 37/444

* cited by examiner

*Primary Examiner*—Donald Underwood
(74) *Attorney, Agent, or Firm*—Dorsey & Whitney LLP

(57) ABSTRACT

An expandable implement attachment selectively connectable to a vehicle and having a frame assembly, a first bucket member laterally fixed to the frame assembly and a second bucket member laterally moveable relative to the frame assembly to provide a bucket with an adjustable width.

19 Claims, 11 Drawing Sheets

EXPANDABLE IMPLEMENT ATTACHMENT

RELATED APPLICATION

This application claims the benefit of Provisional Application Ser. No. 60/607,563 filed Sep. 7, 2004.

BACKGROUND OF THE INVENTION

1. Field of the Invention

The present invention relates generally to an expandable implement attachment and more particularly to a selectively expandable and retractable bucket/scraper designed for connection to a driven vehicle or implement such as a tractor, truck, skid steer vehicle or the like.

2. Description of the Prior Art

Implement attachments such as loading buckets, scrapers and the like are available for selective attachment to a wide variety of self-propelled driven vehicles or implements such as tractors, trucks, bulldozers, skid steer vehicles and the like. These implement attachments are selectively attached to and detached from such vehicles by quick attachment mechanisms known in the art.

For the most part, such implement attachments have a fixed configuration and size which is designed for performing a particular task such as lift, carry and dump or pushing or scraping, etc. Thus, if different tasks need to be performed, this normally involves changing implement attachments. Further, implement attachments such as buckets and scrapers come in a variety of sizes with different load capacities, different widths, etc. Thus, if a bucket with a different load capacity or a bucket or scraper with a different width is needed or desired, several implement attachments must be maintained and periodically attached to and detached from the vehicle as particular needs change. This requires the maintenance of an inventory of several implement attachments such as loading buckets of different capacities and scrapers and buckets of different widths. Significant downtime is also required to change from one implement attachment to another. Further, when the business of the driven vehicle owner requires travel to a variety of work sites or locations such as snow removal and the like, the transport of several implement attachments to those work sites is often required.

Accordingly, there is a need for a single implement attachment or a limited number of implement attachments which are capable of performing a variety of tasks such as lift, carry and dump as well as scraping and which are capable of being adjusted to provide different load capacities and different widths.

SUMMARY OF THE INVENTION

In contrast to the prior art, the present invention provides an implement attachment which is capable of performing a variety of tasks and is capable of adjustment to different load capacities and different widths. More specifically, the present invention is directed to a selectively expandable and retractable bucket/scraper attachment for a driven vehicle such as a truck, tractor, skid steer vehicle or the like. Although the preferred implement attachment of the present invention may be attached to the front or rear of a driven vehicle, it has particular applicability as a front end loader/scraper.

In a preferred embodiment, the implement attachment of the present invention includes a center bucket and a pair of selectively expandable side buckets or side bucket extensions which are controlled via the hydraulic system of the driven vehicle. The bucket extensions are movable between a retracted position in which the implement attachment functions as a loader and/or scraper with a first load capacity and width and an expanded position in which the implement attachment functions as a loader and/or scraper with a second load capacity and width. For example, in the preferred embodiment, a six foot wide loader/scraper can be expanded to a ten foot wide loader/scraper and an eight foot wide loader/scraper can be expanded to a fourteen foot wide loader/scraper.

When the implement attachment is in its expanded position, means are provided for allowing the center bucket and the expandable side buckets to pivot relative to one another to ensure that the leading edge of the center bucket and the side buckets are at the same level so that both can engage the ground when the frame assembly is tipped forwardly.

Accordingly, it is an object of the present invention to provide an implement attachment which is selectively expandable and retractable to accommodate different load capacities and/or widths.

These and other objects of the present invention will become apparent with reference to the drawings, the description of the preferred embodiment and the appended claims.

DESCRIPTION OF THE PREFERRED EMBODIMENT

The present invention is directed to a selectively adjustable implement attachment which can be selectively adjusted to alter its load capacity and/or width. Although the implement attachment of the present attachment can be attached to the front or back of a self-propelled, driven implement or vehicle such as a truck, tractor, skid steer loader or the like, it has particular applicability as a front end loader and/or scraper for snow, dirt, or the like. Further, although the concept of the adjustable implement attachment of the present invention has applicability to a variety of implement attachments, it has particular applicability as an expandable bucket or an expandable bucket/scraper combination.

Accordingly, the implement attachment of the present invention will be described with respect to a selectively expandable and retractable bucket/scraper which may be selectively attached and detached from an implement via conventional means. Further, the present invention will be described with respect to two embodiments. A first embodiment shown in FIGS. 1-12 (sometimes referred to as the FIG. 1 embodiment) and a second embodiment shown in FIGS. 13-23 (sometimes referred to as the FIG. 13 embodiment).

Figure 1:
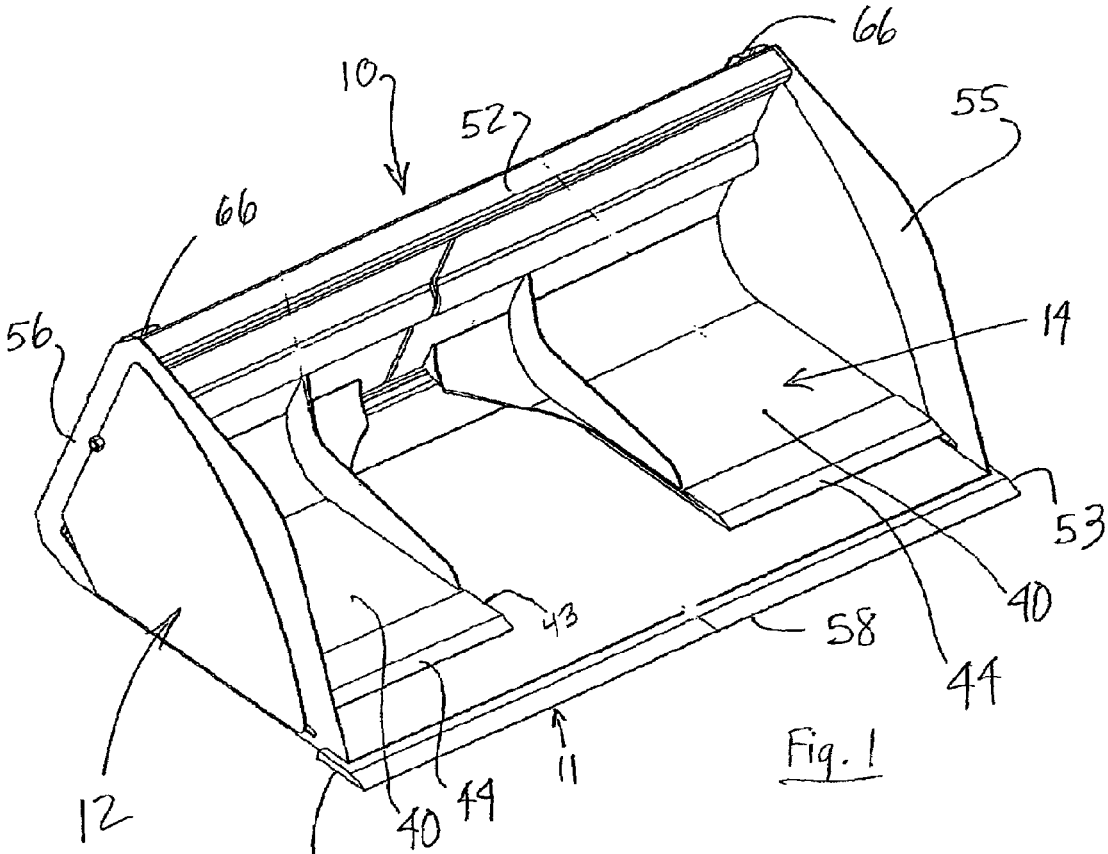
FIG. 1 is an isometric view of one embodiment of the implement attachment of the present invention in its fully retracted position as viewed from the right front.
Figure 2:
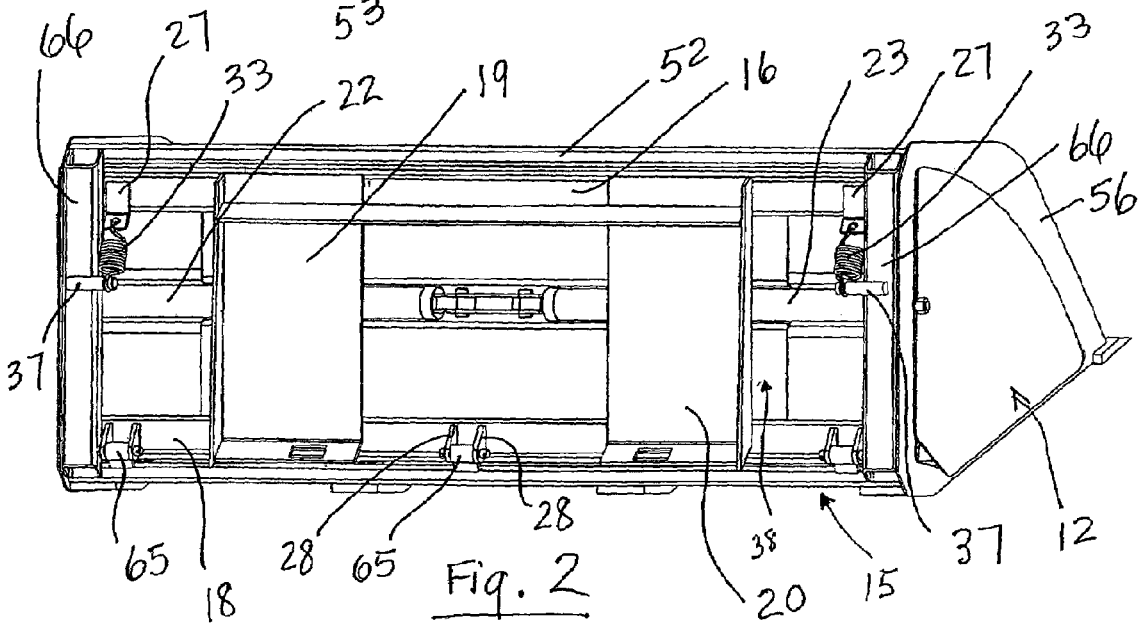
FIG. 2 is an isometric view of the implement attachment embodiment of FIG. 1 in its fully retracted position as viewed from the right rear.
Figure 3:
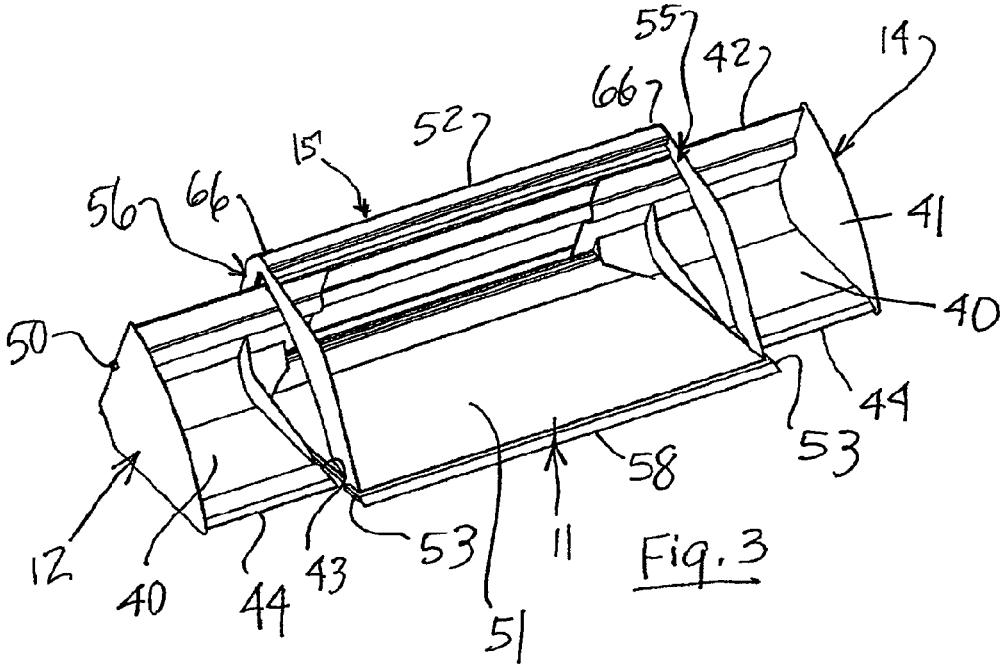
FIG. 3 is an isometric view of the implement attachment embodiment of FIG. 1 in its expanded position as viewed from the right front.
Figure 4:
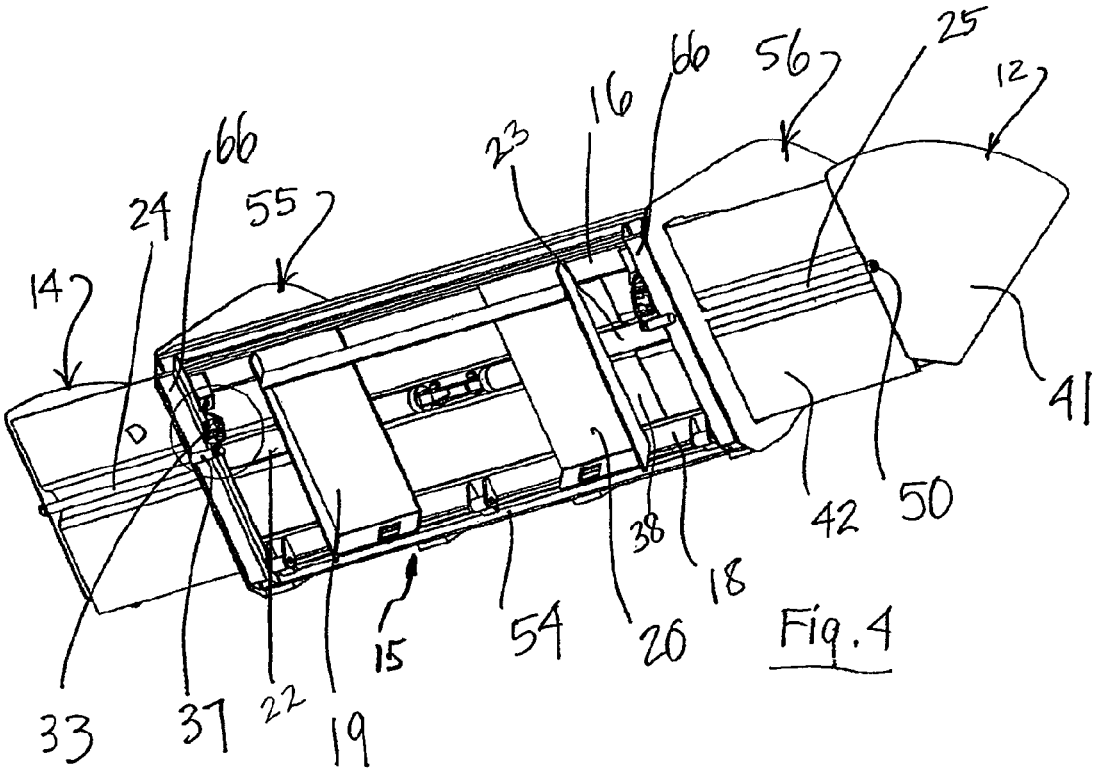
FIG. 4 is an isometric view of the implement attachment embodiment of FIG. 1 in its expanded position as viewed from the right rear.

With reference first to FIGS. 1-4 showing the first embodiment, the implement attachment 10 of the present invention includes a plurality of bucket members including a center bucket 11 and a pair of expandable side buckets or side bucket extensions 12 and 14. The bucket members 11, 12 and 14 are operatively connected relative to a main frame or frame assembly 15. As shown, the side bucket extensions 12 and 14 are operatively connected to be selectively movable relative to the frame assembly 15 and relative to the center bucket 11 between a fully retracted position as shown in FIGS. 1 and 2 and a fully expanded position as shown in FIGS. 3 and 4. The center bucket 11 is operatively connected to be laterally fixed relative to the frame assembly 15.

As shown best in FIGS. 2, 4, 5 and 6, the frame assembly 15 includes a pair of vertically spaced, laterally extending upper 16 and lower 18 frame members and a pair of laterally spaced, vertically extending loader or vehicle mounting plates 19 and 20 which are rigidly secured to the frame members 16 and 18. In the preferred embodiment, the frame members 16 and 18 are rigid tubular members. The implement mounting plates 19 and 20 are conventional "Quik-Tach" means which are connected with the rearward side of the frame members 16 and 18 by welding or the like. The plates 19 and 20 function to connect the implement attachment to a driven vehicle in a conventional manner.

A double acting cylinder means comprised of the interconnected pair of hydraulic cylinders 22 and 23 are connected to the back surface of a filler plate 38 respectively by welding or brackets, or the like. With this mounting, the cylinders 22 and 23 extend laterally outwardly from opposite sides of the mounting plates 19,20. The laterally extending cylinders are located approximately midway between the frame members 16 and 18. The cylinders 22 and 23 include extendable cylinder rods 24 and 25 which are selectively extendable and retractable in opposite directions from the ends of the cylinders 22 and 23. The cylinders 22 and 23 are driven by a hydraulic power source from the implement (not shown) via the hydraulic hoses 26.

The lower frame member 18 includes means in the form of three pairs of hinge mount brackets 28 for pivotally connecting the center bucket 11 to the frame assembly 15 as will be described in detail below. In the preferred embodiment, the hinge mount brackets 28 are rigidly connected to the rearward face of the lower frame member 18 by welding and each includes an opening 29 to receive a pivot pin.

Figure 5:
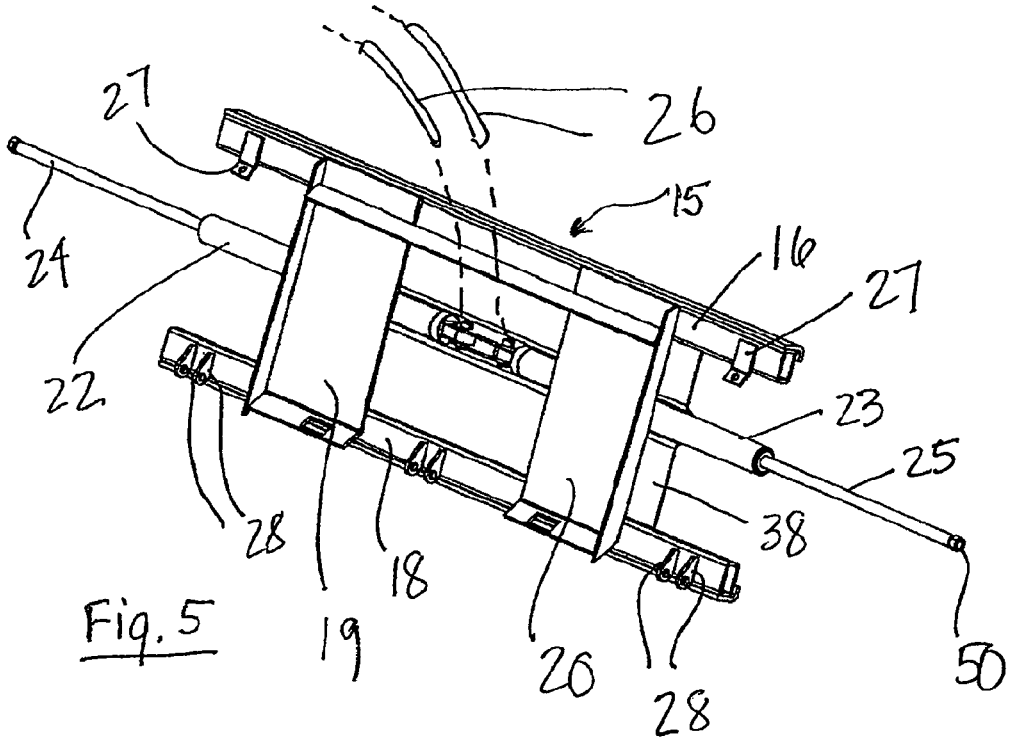
FIG. 5 is an isometric view of the frame assembly of the implement attachment embodiment of FIG. 1 as viewed from the right rear.
Figure 6:
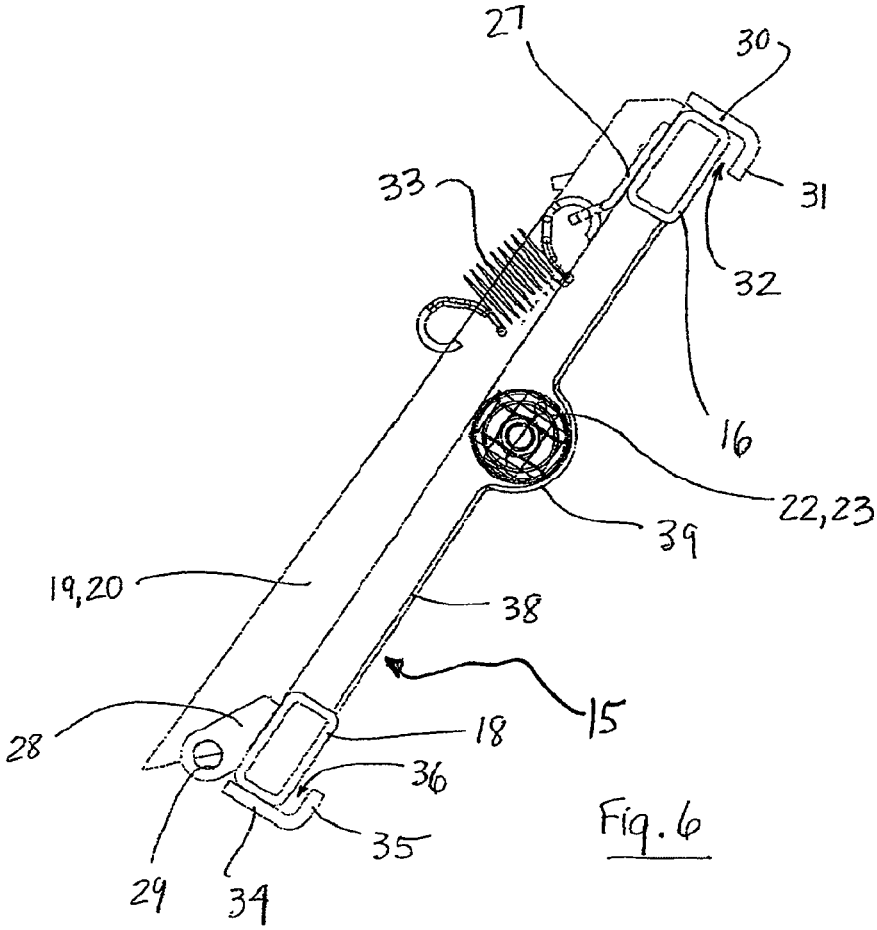
FIG. 6 is a side view of the frame assembly of the implement attachment embodiment of FIG. 1 as viewed from the right-hand side of FIG. 5.

As shown best in FIGS. 5 and 6, a slide track bracket 30 is rigidly connected to the upper surface of the upper frame member 16 by welding or the like. The bracket 30 includes a downwardly extending portion 31 which is spaced from the forward surface of the frame member 16 to define an upper bucket extension slide track 32.

A similar slide track bracket 34 is rigidly secured by welding or the like to the lower surface of the lower frame member 18. This bracket 34 has an upwardly extending portion 35 which is spaced from the front surface of the lower frame member 18 to define a lower bucket extension slide track 36. Both of the slide track brackets 30 and 34 extend for the entire length of their respective upper and lower frame members 16 and 18.

A pair of return spring attachment plates 27 are connected by welding or the like to the rear surface of the frame member 16. These plates 27 include an opening to receive one end of a return spring 33 (FIGS. 2, 4, 6 and 12) to limit forward pivotal movement of the frame assembly 15 and the bucket extensions 12 and 14 relative to the center bucket 11 as will be described below.

As shown best in FIGS. 5 and 6, a main frame filler plate 38 is connected between the frame members 16 and 18 by welding or the like. The filler plate 38 is constructed of metal with a sufficient thickness to assist in providing rigidity to the frame assembly 15 and to sufficiently resist loading and/or scraping forces. The plate 38 is provided with a forwardly curved portion 39 to accommodate and protect the cylinder members 22 and 23. The plate 38 and the curved portion 39 extend laterally for a substantial portion of the length of the frame members 16 and 18. In the preferred embodiment, the filler plate 38 extends slightly beyond the inner edges of the bucket extensions 12 and 14 when in their expanded positions.

Figure 7:
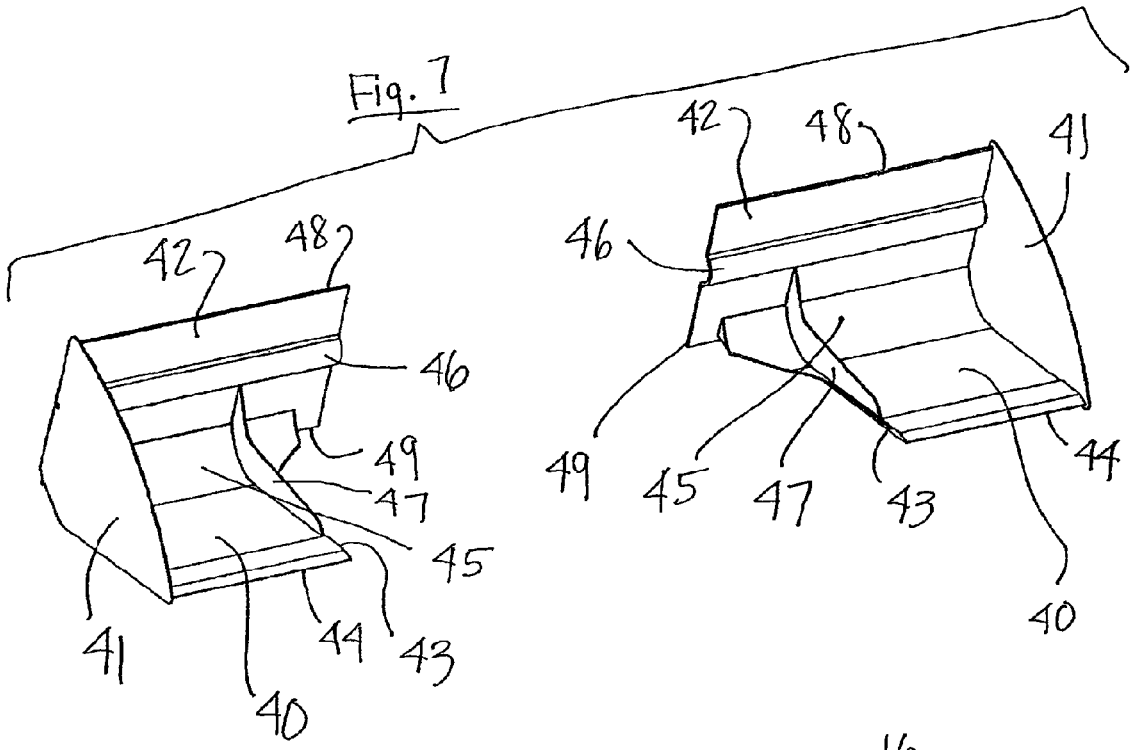
FIG. 7 is an isometric view of the pair of bucket extensions for the implement attachment embodiment of FIG. 1 of the present invention as viewed from the right front.
Figure 8:
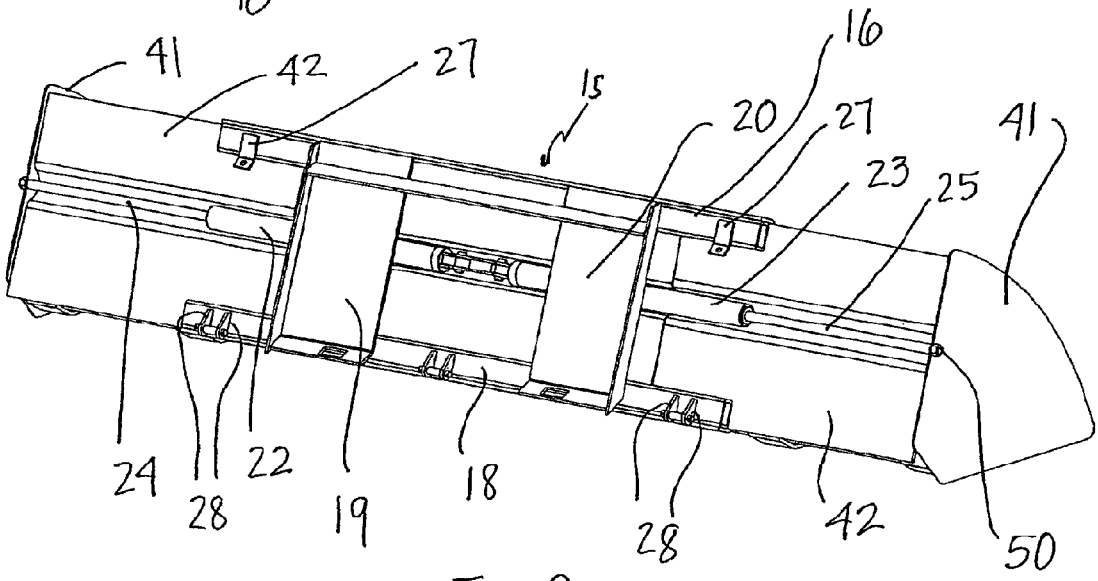
FIG. 8 is an isometric view of the frame assembly and the side bucket extensions of the FIG. 1 embodiment in their expanded position, without the center bucket, as viewed from the right rear.
Figure 9:
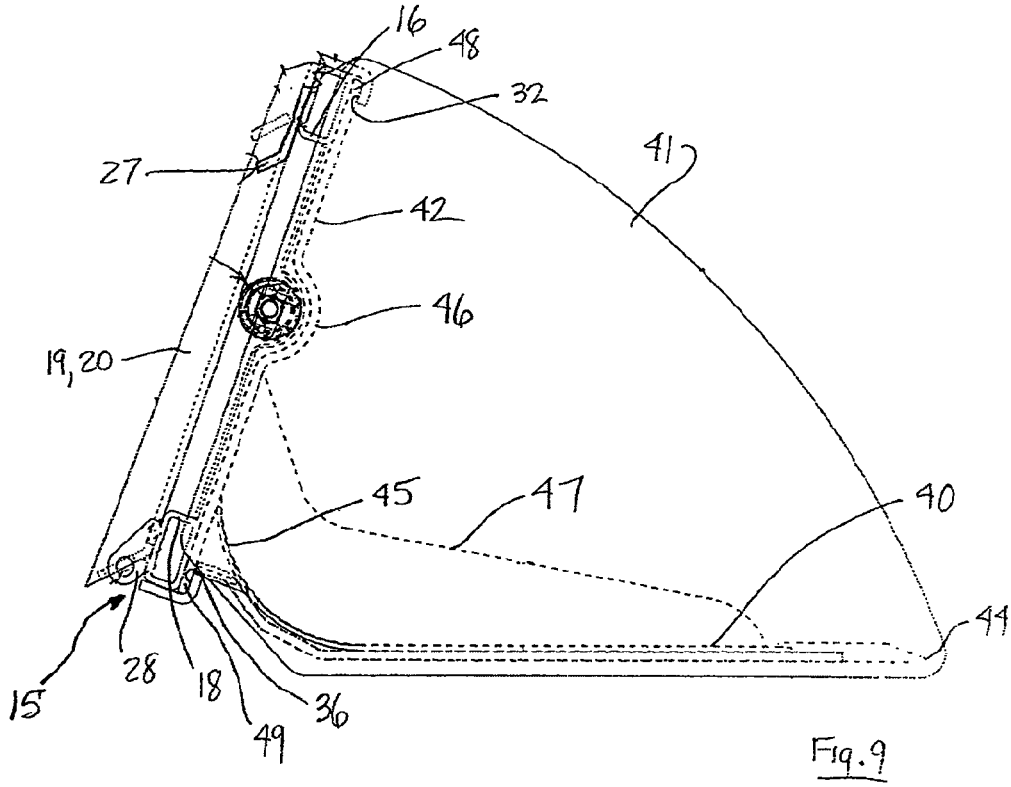
FIG. 9 is a side view of the frame assembly and the side bucket extensions of the FIG. 1 embodiment.

With reference to FIGS. 1, 2, 3, 4, 7 and 8, the side bucket extensions 12 and 14 are designed for selective lateral movement relative to the frame assembly 15 and the center bucket 11 between a fully retracted position as shown in FIGS. 1 and 2 and a fully expanded position as shown in FIGS. 2, 4 and 8. Each of the bucket extensions 12 and 14 includes top and bottom bucket extension slide guide edges 48 and 49, a bucket extension outer side wall 41, a bucket extension inner side wall or reinforcing rib 47 and a bucket extension rear or back wall or plate 42. The bottom wall 40 includes an inner side edge 43 and a forward or leading edge 44 which is designed to engage the ground during a loading or scraping function. A rearward portion of the bottom 40 is rigidly connected to the back wall 42 by welding or the like. Preferably, the rearward portion of the bottom wall 40 curves upwardly near its rearward edge as shown by reference character 45 in FIGS. 7 and 9. The back wall or plate 42 includes a lateral cylinder protecting channel 46 and the top and bottom slide guide edges 48 and 49. As best shown in FIGS. 8 and 9, the top slide guide edge 48 is designed to slide laterally within the upper slide track 32, while the bottom slide guide edge 49 is designed to slide laterally within the lower slide track 36.

As shown best in FIG. 7, the back wall 42 is wider in the lateral direction than the bottom wall 40 between the side wall 41 and the inner edge 43. This additional width (within the slide tracks 32 and 36) functions to support the bucket extensions 12 and 14 in their expanded position and to resist loading and scraping forces. Preferably, the back wall 42 is at least about 20% wider, more preferably at least about 30% wider and most preferably about 33% wider than its corresponding bottom all 40.

The bucket extension inner side wall which functions as a reinforcing rib 47 is welded to a portion of the back wall 42 and to a top surface portion of the bottom wall 40 near the inner edge 43. The rib 47 functions to reinforce and provide rigidity to the bucket extensions 12 and 14.

Each of the side walls 41 is rigidly connected to the outer edge of the back wall 42 and to the outer edge of the bottom wall 40 by welding or the like. Preferably, the outer peripheral edges of the side walls 41 extend a limited distance beyond the bottom surface of the bottom wall 40 and the rearward surface of the back wall 42 as shown. This enables the inner peripheral surface of the walls 41 to engage the outer surface of one of the side wall portions 55 and 56 of the center bucket 11 as described below. Each of the side walls 41 includes an opening near its rearward edge to receive a respective one of the outer ends of the cylinder rods 24 and 25 (FIG. 8). Specifically, in the preferred embodiment, an outer threaded end of each of the cylinder rods 24 and 25 extends through a corresponding opening in one of the side walls 41 and is connected thereto by a threaded nut 50.

With this structure, selected extension and retraction of the cylinders 22 and 23 and their respective cylinder rods 24 and 25 will cause the bucket extensions 12 and 14 to slide outwardly and inwardly relative to the frame assembly 15. This sliding movement is guided by the upper and lower slide guide edges 48 and 49 of the back walls 42 within the slide tracks 32 and 36.

Figure 10:
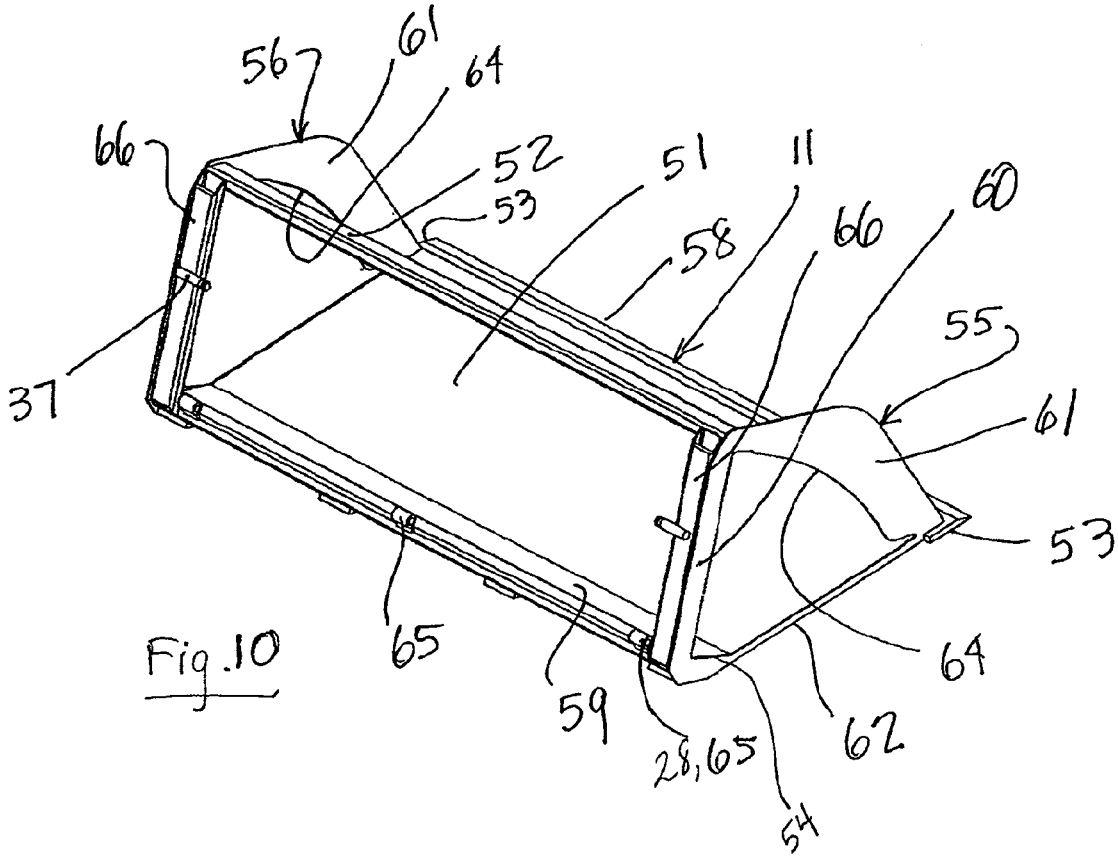
FIG. 10 is an isometric view of the center bucket for the implement attachment embodiment of FIG. 1 as viewed from the right rear.
Figure 11:
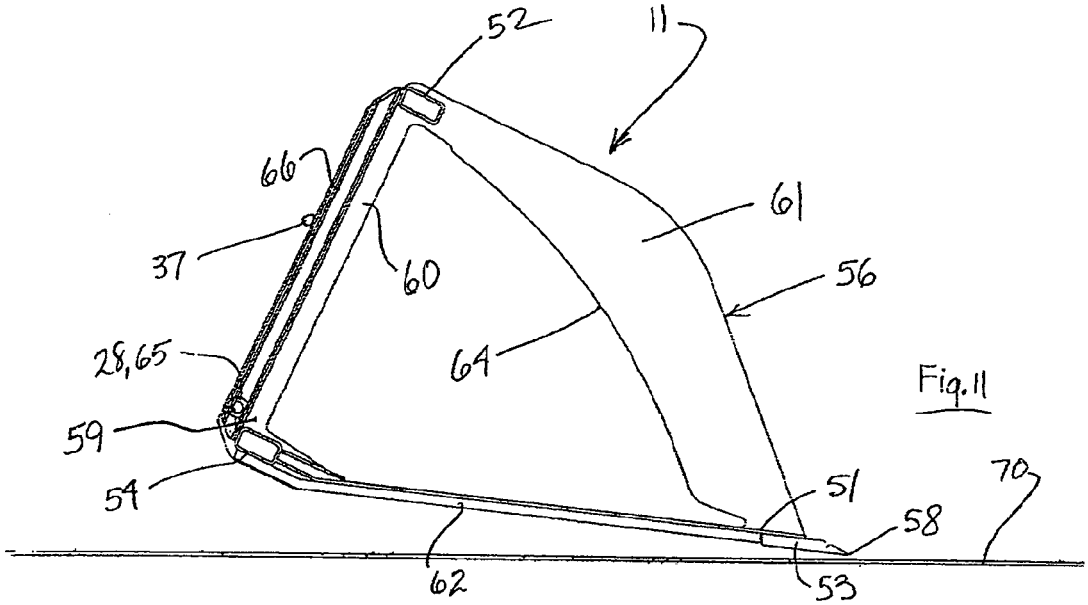
FIG. 11 is an elevational side view of the center bucket for the implement attachment embodiment of FIG. 1, with the center bucket tipped forwardly.

The center bucket 11 is shown best in FIGS. 10 and 11, with reference also being made to FIGS. 1-4 showing relationship of the center bucket member 11 to the frame assembly 15 and the expandable side bucket members 12 and 14. The center bucket 11 includes a bottom wall 51, upper 52 and lower 54 rear wall frame members and a pair of side wall portions 55 and 56. The bottom wall 51 includes a front or leading edge 58, a pair of side edges and a rearward portion 59. The side edges comprise a main side edge portion 62 and a forward side edge portion 53. The rearward portion 59 extends upwardly and rearwardly from the main portion of the bottom wall 51. Each of the side wall portions 55 and 56 includes a rearward leg or portion 60, a bottom wall portion which is connected with and defines the bottom wall side edges 62 and a forwardly extending portion 61. Preferably the side wall portions 55 and 56 are integrally formed from a metal material having sufficient thickness to resist the various forces exerted on the center bucket during use. As shown in FIG. 11, the rearward portion 60 is rigidly connected between the lower frame member 54 and the upper frame member 52 by welding, while the bottom wall portion is connected with and define the side edges 62 of the bottom wall 51 by welding. The forwardly extending portion 61 extends from the upper end of the portion 60 to the forward end of the portion 62. In FIG. 10, the side wall portions 60, 61 and 62 define an opening 64 in each of the side wall portions 55 and 56 to accommodate lateral movement of the side buckets 12 and 14 as will be described in greater detail below. Preferably, the openings 64 are sufficiently large to permit passage of walls 40 and 42 of the bucket extensions 12 and 14 during expansion and retraction movement, but slightly smaller than the side walls 41.

As shown in FIGS. 1, 3 and 10, the forward side edge portions 53 are at both ends of the forward edge 58 of the bottom wall 51. These edge portions 53 extend laterally outwardly from the side edge portion 62. This lateral extension of the edge portions 53 insures that when the bucket extensions 12 and 14 are in their fully extended positions, there will be a complete clean sweep across the entire width of the expanded bucket.

With continuing reference to FIGS. 10 and 11, a plurality of pin hinge members 65 are rigidly connected to the bottom frame member 54 by welding or the like and are laterally spaced so that they mate with the three pairs of hinge mount brackets 28 of the frame assembly 15. Thus, when assembled, the center bucket 11 is connected with the frame assembly 15 for limited pivotal movement. Such pivotal movement is permitted by positioning the pin hinge members 65 between respective pairs of hinge mount brackets 28 and inserting a pivot pin through the respective openings in the pin hinges 65 and the brackets 28.

A pair of vertically extending frame members 66 are rigidly connected to the outer edge of the side wall portion 60 and between the upper and lower frame members 52 and 54. These members 66 function to reinforce and provide rigidity to the rearward frame portion of the center bucket 11. As described in greater detail below, these members 66 also function to limit the rearward pivotal movement of the frame 15 and bucket extensions 12 and 14 relative to the center bucket 11.

A pair of return spring attachment pins 37 are connected with a rear face of the frame members 66 by welding or the like. These pins 37 have a portion extending inwardly from the frame members 66 for connection to an end of the return springs 33 (FIGS. 2, 4, 6 and 12). The pins 37 may include a spring retaining groove or opening if desired.

When the above-described structure is fully assembled, the frame assembly 15 and each of the bucket extensions 12 and 14 are operatively connected with the implement via the mounting plates 19 and 20 and conventional attachment means. Thus, the frame assembly 15 and the bucket extensions 12 and 14 raise, lower and tilt in response to corresponding movement of the implement attachment means. The bucket extensions 12 and 14 are also movable laterally relative to the frame assembly 15 between a fully retracted and a fully expanded position. When fully assembled, the center bucket 11 is connected with the main frame assembly 15 via the hinges 65 and the hinge mount brackets 28.

When the bucket extensions 12 and 14 are in their fully or partially retracted positions, the bottom surfaces of the side bucket bottom walls 40 are in substantial engagement with the top surface of the center bucket bottom wall 51. When the side bucket extensions 12 and 14 are in their fully retracted positions, the inner peripheral surfaces of the side walls 41 are also in substantial engagement with the outer surfaces of the center bucket side wall portions 55 and 56. Because the side walls 41 are slightly larger than the openings 64 in the side walls 55 and 56, the openings 64 will be fully covered by the side walls 41 when the bucket extensions 12 and 14 are in their fully retracted position. When the implement attachment is in its fully or partially retracted position, pivotal movement of the center bucket 11 relative to the frame assembly 15 and the bucket extensions 12 and 14 is prevented. Specifically, in this position, rearward pivotal movement of the center bucket 11 is prevented because of the substantial engagement between the respective bucket bottom walls 40 and 51, while forward pivotal movement of the center bucket 11 is prevented because of substantial engagement between the forward surface of the frame members 66 and the rearward surface of the upper frame member 16.

Figure 12:
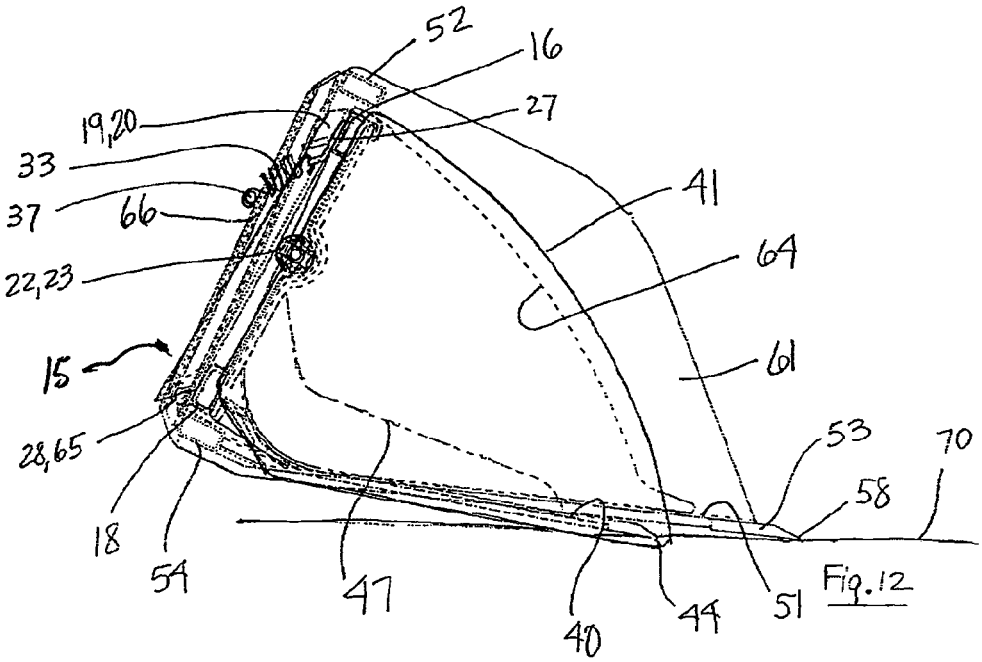
FIG. 12 is an elevational side view of the implement attachment embodiment of FIG. 1 with bucket tipped forwardly and showing the side bucket extensions pivoted forwardly relative to the center bucket.

When the bucket extensions 12 and 14 are in their fully expanded position, the inner edges 43 of the side bucket bottom walls 40 are outside the corresponding center bucket side edge portions 62. In this position, the center bucket bottom walls 40 are no longer in substantial engagement with the center bucket bottom wall 51. Thus, limited rearward pivotal movement of the center bucket 11 relative to the main frame 15 and the bucket extensions 12 and 14 (or forward pivotal movement of the frame assembly 15 and bucket extensions 12 and 14 relative to the center bucket 11) is permitted. This limited rearward pivotal movement of the center bucket 11 permits the leading edges 44 of the side buckets 12 and 14 to engage the ground or other supporting surface 70 when the implement attachment 10 is tipped forwardly as shown in FIG. 12, despite the fact that the edges 44 are positioned rearwardly of the edge 58. In this position, even if the edges 43 are a limited distance outside the side edge portions 62, the outwardly extending side edge portions 53 will insure a complete clean sweep across the entire width of the expanded bucket. This pivotal movement is limited by the return spring assembly comprised of the return springs 33, the attachment plates 27 and the pins 37. Each of the springs 33 is a tension spring with one end connected with a respective plate 27 on the frame member 16 and an opposite end connected with a respective pin 37 on the frame member 66. Then as the side bucket extensions 12 and 14 pivot forwardly relative to the center bucket 11, the springs 33 are tensioned to limit such pivotal movement.

Having described the structure of the implement attachment of the present invention, its operation can be understood as follows. First, if the implement attachment is not connected with the driving vehicle or implement, the attachment is connected with the implement in a conventional manner via a conventional connection between the driven implement and the mounting plates 19 and 20 (FIGS. 2, 4, 5 and 6). The hydraulic hoses 26 for the cylinders 22 and 23 are also connected to a hydraulic power source on the driven implement.

When attached to the driven implement, the implement attachment 10 of the present invention is ready for use. In its fully retracted position as shown in FIGS. 1 and 2, the bucket extensions 12 and 14 are fully retracted via the cylinders 22 and 23 so that the inner surfaces of the bucket extension side walls 41 engage the outer surfaces of the side wall portions 55 and 56. In this position, as shown in FIG. 1, the bottom walls 40 of the bucket extensions 12 and 14 are supported on the upper surface of the center bucket bottom wall 51 and the center bucket 11 is movable in unison with the frame assembly 15 and the bucket extensions 12 and 14. In this position, the implement attachment 10 can be used as a conventional bucket loader to lift, carry and dump snow, dirt or other materials or can be used as a scraper with a width equal to the width of the center bucket member 11. In this retracted configuration, the center bucket leading edge 58 functions as the sole scraping or cutting edge.

To convert the implement attachment 10 to its fully expanded position, the hydraulic cylinders 22 and 23 are actuated by the operator on the driven implement. This causes the bucket extensions 12 and 14 to move laterally outwardly relative to the frame assembly 15 and the center bucket 11. When the side buckets 12 and 14 are in their fully expanded or extended positions as shown in FIGS. 3 and 4, the inner edges 43 of the side bucket bottom walls 40 are positioned outside the outer side edge portions 62 of the center bucket bottom wall 51. This relative position of the side edges 43 and the side edge portions 62, together with the pivotal connection between the center bucket 11 and the frame assembly 15 enables the side buckets 12 and 14 (and the frame assembly 15) to pivot forwardly a limited distance relative to the center bucket 11 when the attachment is tipped. The amount of this limited forward movement is constrained by the return spring assembly comprised of the return springs 33, the attachment plates 27 and the pins 37 and by the angle at which the attachment is tipped. In contrast, rearward pivotal movement of the frame assembly 15 and the side extension buckets 12 and 14 relative to the bucket 11 beyond the positions shown in FIGS. 1 and 2 is still prevented as a result of the engagement and interference between the reinforcing frame members 66 and the top frame member 16.

This limited forward pivotal movement of the bucket extensions 12 and 14 relative to the center bucket 11 is desirable, particularly when the attachment is used in a scraping function and the attachment is tipped or tilted forwardly. When the expanded bucket is tilted forwardly, with the leading edge 58 in contact with the ground, such pivotal movement allows the leading edges 44 of the side bucket extensions 12 and 14 to be at the same level relative to the ground or supporting surface 70 (FIG. 12) as the leading edge 58 of the center bucket 11. This relative pivotal movement is automatic and results from engagement of the leading edge 58 of the center bucket 11 with the ground 70 when the expanded bucket is tipped forwardly. Thus, regardless of the relative pivotal position of the bottom walls 40 and 51 relative to the ground (except as constrained by the return spring assembly), the leading edges 44 and 58 of the bottom walls 40 and 51, respectively, will automatically adjust to ground level. When in its fully expanded position, the implement attachment functions as a loader or scraper with an expanded load capacity and width.

To return the implement attachment to its retracted position, the attachment is tilted back or raised so that the frame members 66 of the bucket 11 and the upper frame member 16 are in substantial engagement. In this position, the bottom walls 40 and 51 are substantially parallel to one another, with the bottom surface of the bottom wall 40 even with or slightly above the top surface of the bottom wall 51. The cylinders 22 and 23 are then actuated to retract the extensions 12 and 14 until they reach their fully retracted positions.

Figure 13:
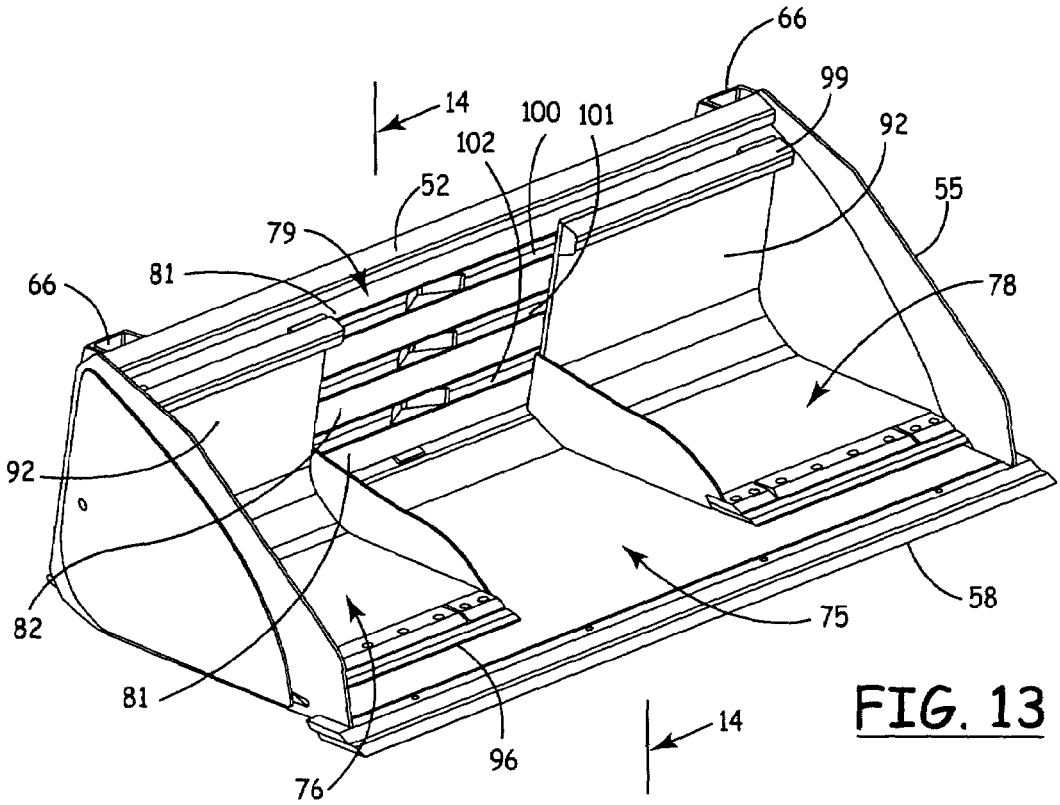
FIG. 13 is an isometric view of a further embodiment of the implement attachment of the present invention in its fully retracted position as viewed from the right front.
Figure 14:
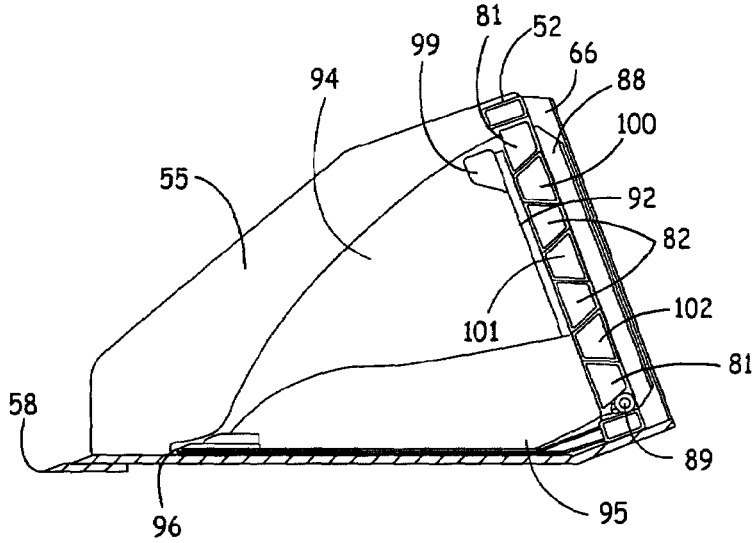
FIG. 14 is a view, partially in section, as viewed along the section line 14-14 of FIG. 13.
Figure 15:
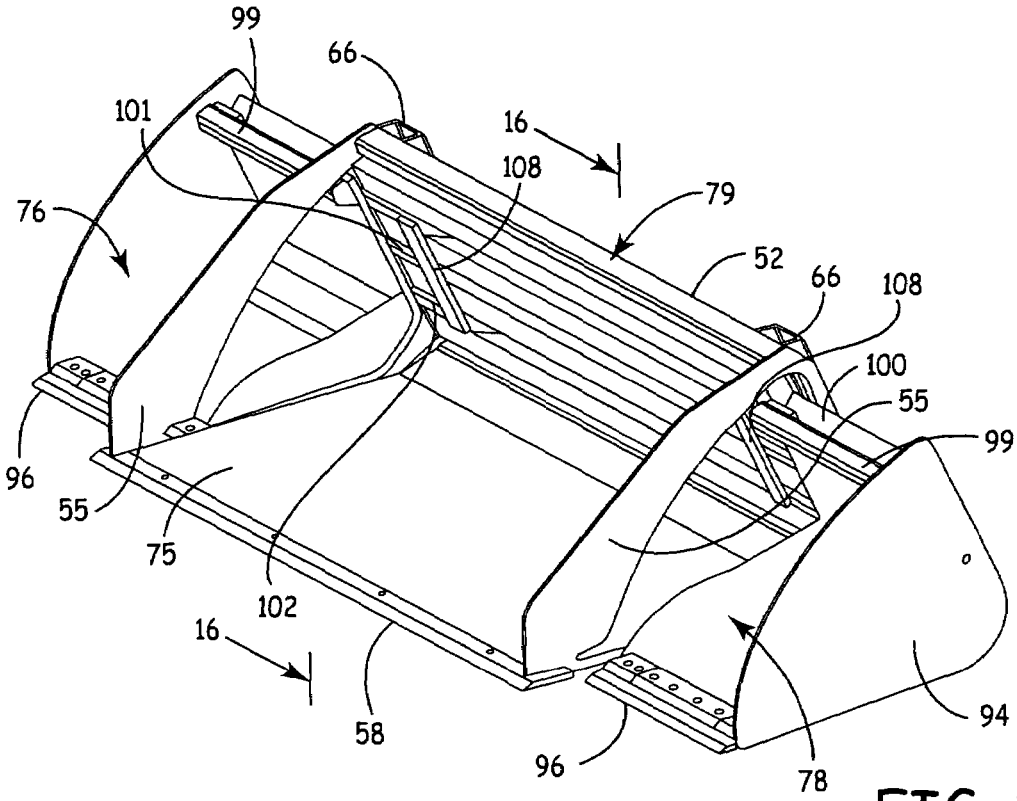
FIG. 15 is an isometric view of the implement attachment embodiment of FIG. 13 in its expanded position as viewed from the left front.
Figure 16:
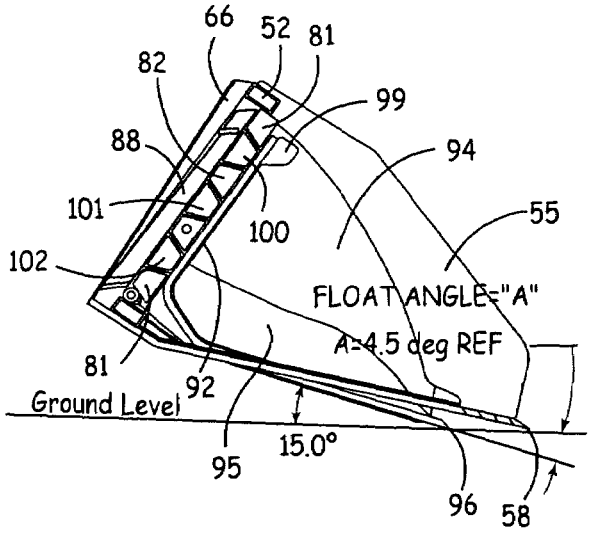
FIG. 16 is a view, partially in section, as viewed along the section line 16-16 of FIG. 15.
Figure 17:
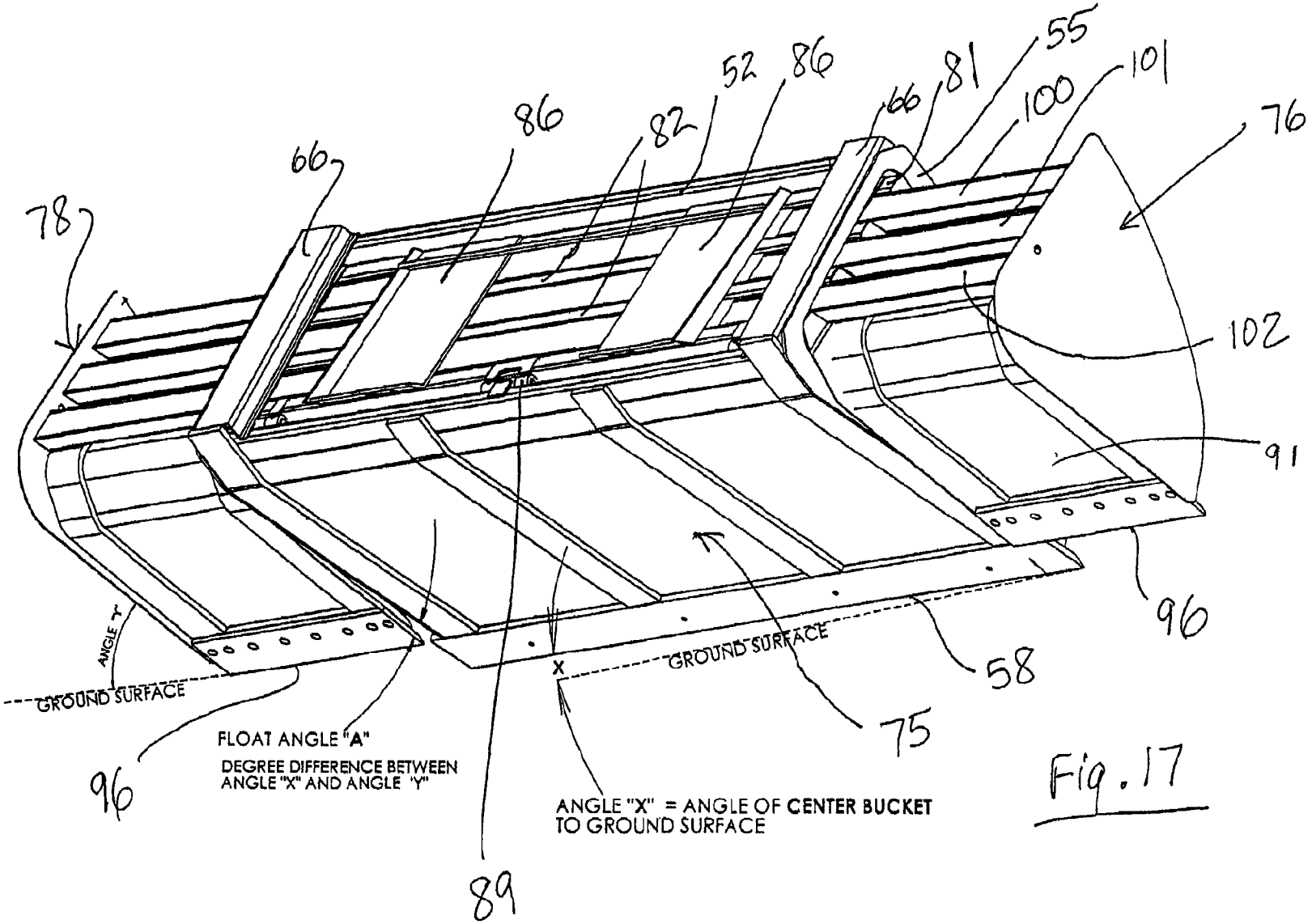
FIG. 17 is an isometric view of the implement attachment embodiment of FIG. 13 in its expanded and forwardly tipped position as viewed from the lower right rear.

A further embodiment of the implement attachment of the present invention is shown in FIGS. 13-23. Similar to the embodiment of FIGS. 1-12, the embodiment of FIGS. 13-23 is an adjustable implement attachment which can be selectively adjusted to alter its load capacity and/or width. It includes a center bucket member 75, a pair of side bucket members or bucket extensions 76 and 78 and a main frame or frame assembly 79. The bucket extensions 76 and 78 are moveable outwardly and inwardly between a fully retracted position as shown in FIG. 13 and a fully expanded position as shown in FIGS. 15 and 17. The movement of the bucket extensions 76 and 78 between its retracted and expanded positions is accomplished by a pair of hydraulic cylinders (not shown in FIGS. 13-22) similar to the cylinders 22 and 23 of the FIG. 1 embodiment. These cylinders would be connected between the main frame 79 and the bucket extensions 76 and 78.

Many of the structural features of the FIG. 13 embodiment are the same as or similar to the FIG. 1 embodiment. For example, the center bucket 75 of the FIG. 13 embodiment is substantially the same as the center bucket 11 of the FIG. 1 embodiment. Accordingly, the detailed description of the FIG. 1 embodiment is incorporated into the disclosure of the FIG. 13 embodiment. The main difference between the two embodiments relates to the means for guiding the lateral movement of the bucket extensions 76 and 78 relative to the center bucket 75 and the main frame 79 between their retracted and expanded positions. Accordingly, the main structural differences between the two embodiments involve the slide or guide rails 81 and 82 of the main frame 79 and the corresponding slide or guide rails 100, 101 and 102 of the bucket extensions 76 and 78.

Figure 19:
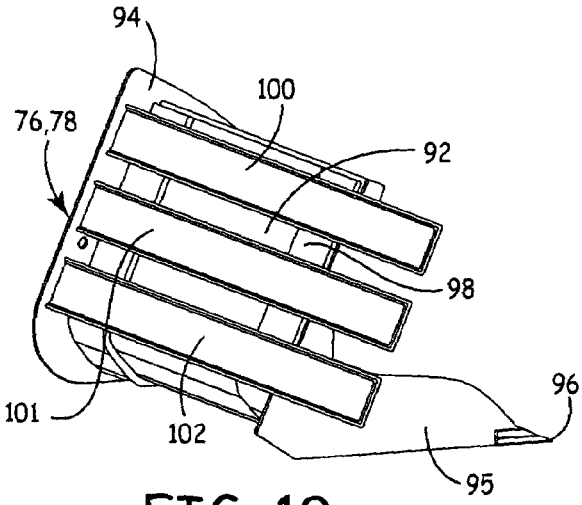
FIG. 19 is an isometric view of the left-hand bucket extension of the FIG. 13 embodiment as viewed from the right rear.
Figure 20:
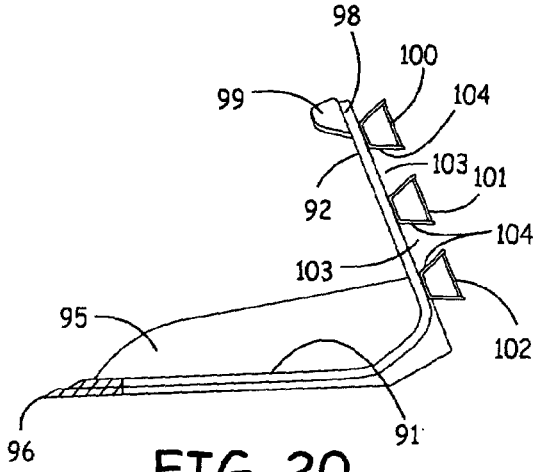
FIG. 20 is a view, partially in section, as viewed along the section line 20-20 of FIG. 18.
Figure 21:
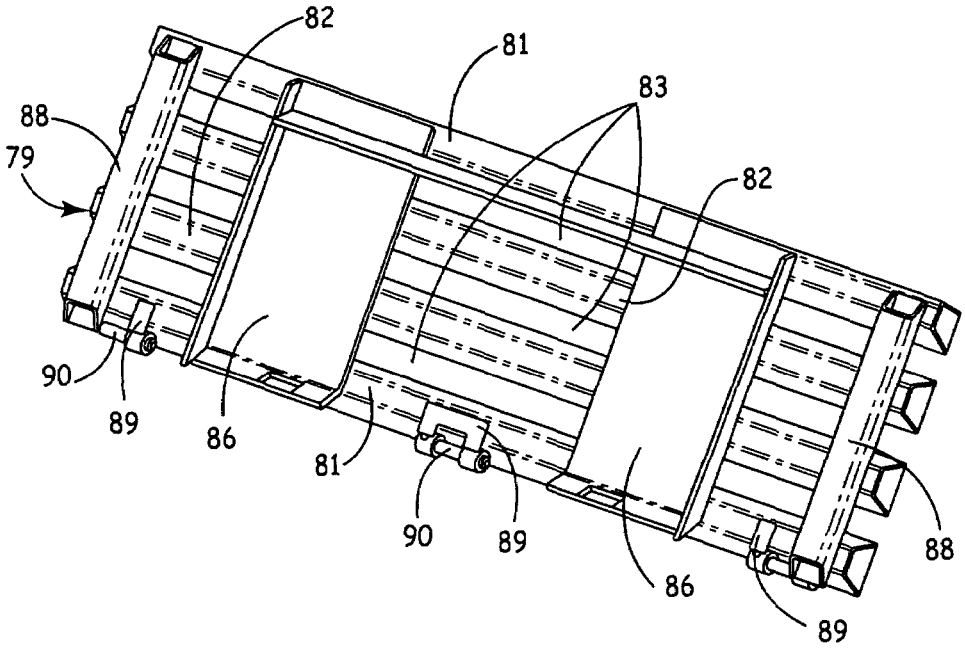
FIG. 21 is an isometric rear view of the main frame of the FIG. 13 embodiment.
Figure 22:
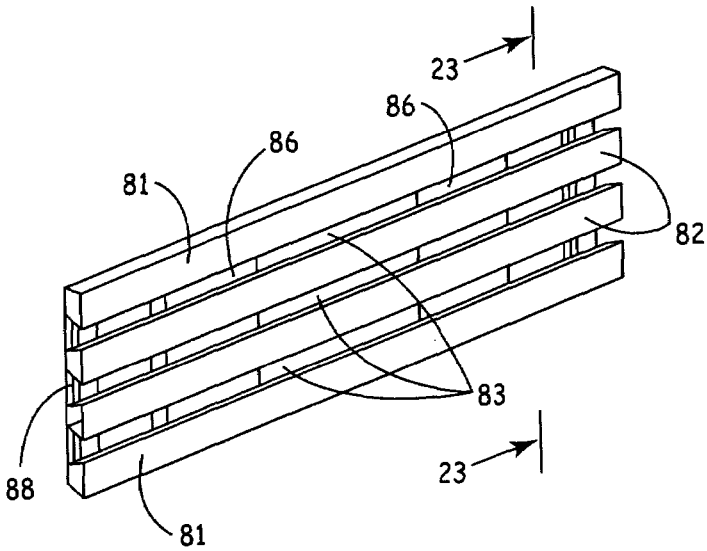
FIG. 22 is an isometric front view of the main frame of the FIG. 13 embodiment.
Figure 23:
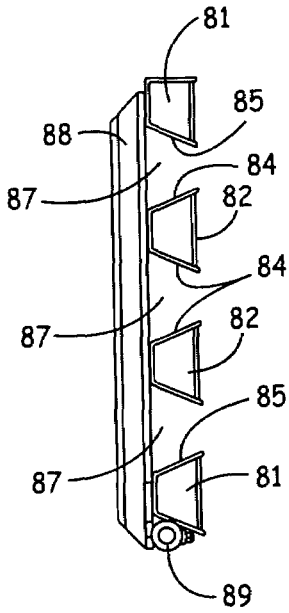
FIG. 23 is a view, partially in section, as viewed along the section line 23-23 of FIG. 22.

With general reference to FIGS. 13-22 and specific reference to FIGS. 21, 22 and 23, the main frame 79 includes a plurality of laterally extending slide or guide rails comprising a pair of outer slide rails 81 and a pair of inner slide rails 82. As shown, the inner slide rails 82 are tubular in construction with a generally trapezoid cross-sectional configuration. Thus, each of the inner slide rails 82 includes a pair of beveled exterior slide or guide surfaces 84. The pair of outer slide rails 81 are also tubular in construction and each includes an inner facing beveled exterior slide or guide surface 85 adjacent to one of the inner slide rails 82. The slide rails 81 and 82 are rigidly connected via welding or the like to a conventional implement attachment means such as the pair of "Quik-Tach" plates 86. Such Quik-Tach plates 86 provides a mounting arrangement for a skid steel vehicle. The slide rails 81 and 82 are further rigidly interconnected via welding near their ends via the pair of retainer tubes or frame members 88. A plurality of filler plates 83 are provided between adjacent rails 81,82 and between the plates 86 to provide a bucket back between the bucket extensions 76 and 78. These filler plates 83 are welded to the rear surface of the slide rails 81 and 82.

As shown best in FIG. 23, the rails 81 and 82 are vertically spaced from one another to provide a sliding recess or gap 87 between adjacent rails 81, 82. These gaps 87, defined by the surfaces 84 and 85 and the forward surfaces of the plates 86 and 83, provide sliding recesses for the bucket extensions 76 and 78. A plurality of hinge members 89 and pivot pins 90 are rigidly secured to the bottom slide rail 81 for pivotal connection to the center bucket 75 as shown and described with respect to the FIG. 1 embodiment.

Figure 18:
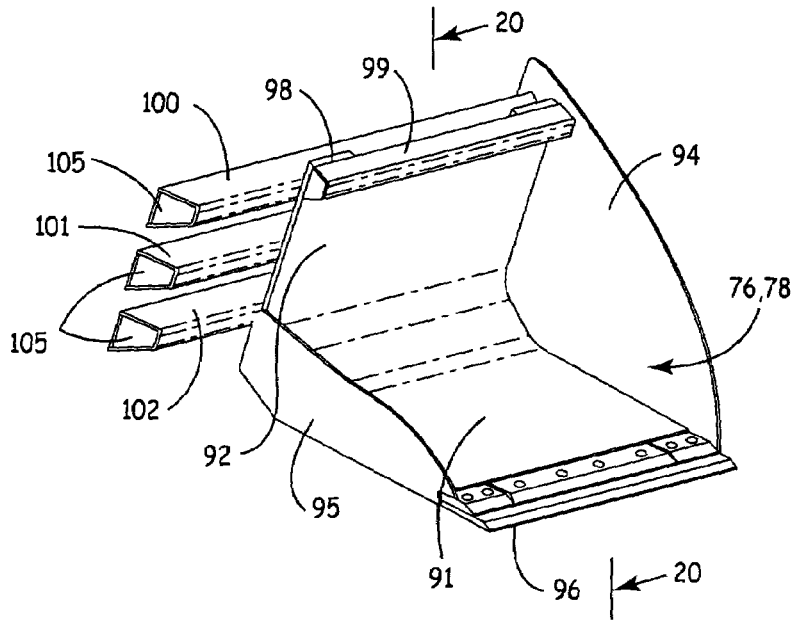
FIG. 18 is an isometric view of the left side bucket extension as viewed from the right front.

With continuing general reference to FIGS. 13-23 and more specific reference to FIGS. 18-20, each of the bucket extensions includes a bottom wall 91, a rear wall 92, an outer side wall 94, an inner side wall 95 and a front edge 96. These elements are substantially the same as corresponding elements of the FIG. 1 embodiment. The back wall 92 and the bottom wall 91 are rigidly secured such as by welding or the like to a pair of skid bars 98. A tubular member 99 is formed from the top end of the rear wall 92 to provide stability and reinforcement to the bucket extensions 76 and 78. An end cap may be welded to the open inner end of the member 99.

A plurality of slide or guide rails 100, 101 and 102 are rigidly secured to the rearward side of the skid bars 98 by welding or the like. As shown, these slide rails 100-102 extend from the outer side wall 94, along the rear wall 92 and for a limited distance past the inner side wall 95. The slide rails 100-102 extend laterally and are vertically spaced from one another to provide a sliding recess or gap 103 (FIG. 20) between adjacent rails 100-102. Each of the slide rails 100-102 is tubular in construction and has a generally trapezoid cross section with a pair of beveled surfaces 104 extending outwardly from the skid bars 98 as shown best in FIG. 20. The inner ends of the slide rails 100-102 are provided with a beveled end 105.

With the above-described structure, the slide rails 100-102 of each of the side buckets 76 and 78 are designed to slide laterally within the slide recesses 87 (FIG. 23) of the main frame 79. During this sliding relationship, the beveled surfaces 104 of the slide rails 100-102 engage the beveled surfaces 84 and 85 of the slide rails 82 and 83, respectively.

Having described the structural features of the FIG. 13-23 embodiment, its operation can be understood as follows. When the implement attachment is in its fully retracted position as shown in FIG. 13, it can be used as a conventional loader and/or scraper with a width as shown. When it is desired for the width of the attachment to be increased, the actuating cylinders 22 and 23 (shown in FIG. 8 of the FIG. 1 embodiment) are actuated. This causes the bucket extensions 76 and 78 to move outwardly to their expanded position as shown in FIG. 17. When in this expanded position, the bucket extensions 76 and 78 move outwardly past the outer edges of the center bucket 75. With this movement, the bottom wall 91 and front edge 96 of the bucket extensions 76 and 78 clear the center bucket 75. This permits limited pivotal movement between the center bucket 75 on the one hand and the bucket extensions 76 and 78 and the main frame 79 on the other. As described above with respect to FIGS. 1-12 and as shown in FIGS. 15, 16 and 17, this enables the front edge 58 of the center bucket 75 as well as the front edges 96 of the bucket extensions to contact the ground for a scraping function regardless of the angle which the implement attachment forms with the supporting surface. This is accomplished in the same manner as in the FIG. 1 embodiment. Thus, if and when the attachment is tilted forwardly as shown in FIGS. 15, 16 and 17, the leading edge 58 of the center bucket 75 and the leading edge 96 of the bucket extensions remain in contact with the ground. To accommodate this, the main frame 79 and the bucket extensions are allowed to pivot forwardly relative to the center bucket 75. The difference between the angle which the center bucket 75 makes with the ground and the angle which the extensions 76 and 78 make with the ground, when the attachment is tilted forwardly, is referred to as the float angle. If desired, a spring such as the spring 33 of the FIG. 1 embodiment or other means can be provided between the frame 79 and a portion of the center bucket 75 to limit the permitted pivotal movement between the frame 79 and bucket 75.

If desired, a retaining bar 108 (FIG. 15) can be welded to the front edges of the slide rails 100-102 to provide stability and reinforcement and to prevent the slide rails 100-102 and thus the bucket extensions 76 and 78 from pivotable movement relative to the retainer tubes 88 when the bucket extensions are in their expanded positions.

Although the description of the preferred embodiments has been quite specific, it is contemplated that various modifications could be made without deviating from the spirit of the present invention. For example, without limitation, although the embodiment of FIGS. 13-23 show the various slide rails with a trapezoidal cross-section, a variety of other cross-sectional configurations and other mechanisms could be utilized to facilitate lateral movement between the main frame and the side bucket extensions. Further, the slide rails could be solid as opposed to tubular. Accordingly, it is intended that the scope of the present invention be dictated by the appended claims, rather than by the description of the preferred embodiment.

The invention claimed is:

1. An expandable implement attachment comprising:

a frame assembly selectively connectable to a driven vehicle;

a center member hingedly connectable to said frame assembly, said center member comprising a frame, a bottom wall, a leading edge, end plates and an open rear portion;

a first bucket member operatively connected to said frame assembly and comprising a leading edge;

a second bucket member operatively connected to said frame assembly and comprising a leading edge; and said first and second bucket members being laterally moveable between a retracted position and an expanded position relative to the center member, said center member connectable to said frame assembly independently of the first and second bucket members, whereby the three leading edges lie on a single plane independent of an angle of tilt of said first, second and center members when said members are in an operating position.

2. The implement attachment of claim 1 wherein the first and second bucket members are laterally moveable relative to said frame assembly.

3. The implement attachment of claim 2 wherein said first and second bucket members are laterally moveable relative to said frame assembly and said center member between a fully retracted position in which a substantial portion of each of said first and second bucket extensions is positioned between said end plates and a fully expanded position in which a substantial portion of each of said first and second bucket members is positioned laterally outside of said end plates.

4. The implement attachment of claim 3 wherein each of said end plates includes an opening to accommodate lateral movement of said first and second bucket members.

5. The implement attachment of claim 1 wherein said center member is operatively connected to said frame assembly to permit limited pivotal movement between said center member and said frame assembly.

6. The implement attachment of claim 1 including a power cylinder positioned between said frame assembly and said first and second bucket members.

7. The implement attachment of claim 1 wherein said frame assembly includes a plurality of laterally extending frame members.

8. The implement attachment of claim 7 wherein said frame members include upper and lower frame members, each having a slide track.

9. The implement assembly of claim 8 wherein said first and second bucket members includes a slide plate for sliding movement within said slide tracks.

10. The implement assembly of claim 7 wherein said frame members comprise a plurality of first slide rails and at least one of said first and second bucket members having a plurality of laterally extending second slide rails, said first and second slide rails mating with one another to permit relative lateral sliding movement between said first and second slide rails.

11. An expandable implement attachment comprising:

a frame assembly selectively connectable to a driven vehicle, said frame assembly including a plurality of laterally extending frame members;

a first bucket member operatively connected to said frame assembly;

a second bucket member operatively connected to said frame assembly; and at least one of said first and second bucket members being laterally moveable relative to the other of said first and second bucket members between a retracted position and an expanded position, said frame members comprising a plurality of first slide rails and at least one of said first and second bucket members having a plurality of laterally extending second slide rails, said first and second slide rails mating with one another to permit relative lateral sliding movement between said first and second slide rails, wherein said first and second slide rails have generally trapezoidal cross-sections.

12. The implement assembly of claim 10 wherein said frame assembly includes a plurality of filler plates between said first slide rails.

13. The implement assembly of claim 2 wherein each of said first and second bucket members includes a side wall and a bottom wall, said bottom wall carrying the leading edge.

14. An implement attachment comprising:

a frame selectively connectable to a vehicle;

a center member hingedly connectable to said frame, said center member comprising a leading edge and defining an open rear portion;

a first bucket member laterally moveable relative to said frame, laterally and pivotally moveable relative to said center member and comprising a leading edge; and a second bucket member laterally moveable relative to said frame, laterally and pivotally moveable relative to said center member and comprising a leading edge.

15. The implement attachment of claim 14, wherein said first and second bucket members move laterally to the extent that said first and second bucket members do not substantially overlie said center member.

16. The implement attachment of claim 14, wherein the leading edges of the center member and the first and second bucket members overlap.

17. The implement attachment of claim 14, wherein the leading edges of the center member and the first and second bucket members lie on a single plane when said members are in an operating position.

18. The implement attachment of claim 14, wherein, when in an operating position, the center member is at angle of tilt relative to a surface on which the attachment is being used and the first and second bucket members are at another angle of tilt relative to the surface.

19. The implement attachment of claim 18, wherein the three leading edges lie on a single plane independent of the angle of tilt of said first, second and center members when said members are in an operating position.

* * * * *